US005746249A

United States Patent [19]

Wright et al.

[11] Patent Number: 5,746,249

[45] Date of Patent: May 5, 1998

[54] OIL WELL BLOW-OUT PREVENTER AND SEALING DEVICE

[75] Inventors: Andrew Wright, Sherwood Park; Curtis Phillip Ring, Okotoks, both of Canada

[73] Assignee: 569.396 Alberta, Ltd., Leduc, Canada

[21] Appl. No.: 748,031

[22] Filed: Nov. 12, 1996

[51] Int. Cl.[6] ..... E21B 33/06

[52] U.S. Cl. ..... 137/614.19; 251/1.3

[58] Field of Search ..... 251/1.1, 1.3; 137/614.19

[56] References Cited

U.S. PATENT DOCUMENTS 1,967,417 7/1934 Martin ..... 251/1.3 X 2,375,432 5/1945 Miller et al. ..... 251/1.1

*Primary Examiner*—John Fox

*Attorney, Agent, or Firm*—Merek & Voorhees

[57] ABSTRACT

An oil well blow-out preventer and sealing device for use on an oil well equipped with a well casing, a wellhead, a production tubing string, and a pump rod receivable within the production tubing string. The blow-out preventer and sealing device comprises a central housing member that includes a flow passageway and a pump rod passageway, blow-out prevention means and pump rod passageway sealing means, both contained within the central housing member. The flow passageway is in communication with the production tubing string and provides a means for fluid to be removed from the well while the pump rod passageway provides a means for entry of the pump rod into the well. The blow-out prevention means includes a pair of rams that are adjustable to seal around the pump rod to prevent the accidental loss or spillage of oil or fluid from the well. The pump rod passageway sealing means prevents the spillage of fluids from the oil well upon the breakage or removal of the pump rod from said pump rod passageway.

20 Claims, 4 Drawing Sheets

OIL WELL BLOW-OUT PREVENTER AND SEALING DEVICE

FIELD OF THE INVENTION

This invention relates to an apparatus for preventing blow-outs in an oil well and for the sealing of an oil well in the case of breakage or removal of a pump rod, thereby preventing the spillage of oil or fluids from the well.

BACKGROUND OF THE INVENTION

Most production oil wells contain a well casing within which a production tubing string is positioned. The production tubing string serves as both a means to easily insert and remove a pump rod and also provides a conduit for the extraction of oil and fluids from the well. Typically production tubing strings are held within the well casing through the use of a variety of flanges, hangers and other types of devices that tightly seal the well casing allowing fluids to escape or be removed by way of the production tubing string only.

In many cases an oil reserve or pocket is under considerable underground pressure. Once a well has been drilled, the static pressure to which underground oil is subjected often forces oil upwardly through the well. It is therefore important for conservation, safety and environmental reasons to ensure that there are safe and reliable methods of closing off both the well casing and the production tubing string to prevent the unwanted or accidental spillage of oil or other fluids from the well. In the case of the production tubing string, manually actuated valves or similar structures, often referred to as blow-out preventers, have been developed specifically for this purpose. Typically such devices provide a sealing mechanism that encompasses the pump rod in the production tubing string in order to effectively capoff the well. However, such devices offer little assistance in instances where a pump rod breaks near its top, or where the rod has been removed from the production tubing string. In cases of pump rod removal or failure, others have proposed a variety of different methods and devices to seal off the well. These include bolting a flange over the top of the production tubing string and the use of large gate valves mounted in the production tubing string. The inherent short comings with these prior art devices include their inability to operate automatically in the event that a pump rod breaks when a technician is not readily available to shut down the well.

Furthermore, devices that have been proposed and used by others have tended to be large and cumbersome and must be bolted or screwed to the production tubing string. The connection of such devices to the production tubing string results in a wellhead of considerable height and weight. Traditionally such wellheads have been referred to as "Christmas trees" due to their size and the fact that there are usually a large number of elements pointing outwardly from various parts of the tubing string and the components mounted thereon. The servicing of oil wells having such "Christmas trees" attached to their production strings tends to be both complex and time consuming. In addition, with the bolting or screwing together of a large number of component parts, leaking at each junction is often a problem. Where a well casing is inclined or slanted, the considerable weight of these additional devices can place a significant degree of torque upon the various connections, sometimes resulting in failures or stress fracturing.

SUMMARY OF THE INVENTION

The invention therefore provides an oil well blow-out preventer and sealing means which overcomes the short-comings of these prior art devices through the incorporation of a structure providing a unitary body that includes both a blow-out prevention means and a sealing means to automatically prevent the flow and spillage of fluids from the oil well should the pump rod break or be removed. The blow-out preventer and sealing device of the present invention also provides an internal and integrated flow tee in communication with the production tubing string to provide a means to transport fluid from the well.

Accordingly, in one of its aspects the invention provides an oil well blow-out preventer and sealing device for use on an oil well having a well casing, a wellhead, a production tubing string, and a pump rod receivable within the production tubing string, the device comprising: a central housing member for mounting on the wellhead, said central housing member including a flow passageway and a pump rod passageway, said flow passageway being in communication with the production tubing string and providing a means for fluid to be removed from the well, said pump rod passageway providing a means for entry of the pump rod into the well; blow-out prevention means contained within said central housing member, said blow-out prevention means including a pair of rams that are adjustable to seal around the pump rod to prevent the accidental loss or spillage of oil or fluid from the oil well; and, pump rod passageway sealing means contained within said central housing member, said pump rod passageway sealing means preventing the spillage of fluids from the oil well upon the breakage or removal of the pump rod from said pump rod passageway, said pump rod passageway sealing means including a valve member that automatically seals said pump rod passageway, upon the breakage or removal of the pump rod from the well, through the engagement of said valve member with a seating member positioned in said central housing member circumferentially about said pump rod passageway.

BRIEF DESCRIPTION OF THE DRAWINGS

For a better understanding of the present invention, and to show more clearly how it may be carried into effect, reference will now be made, by way of example, to the accompanying drawings which show the preferred embodiment of the present invention in which.

DESCRIPTION OF THE PREFERRED EMBODIMENT

Figure 1:
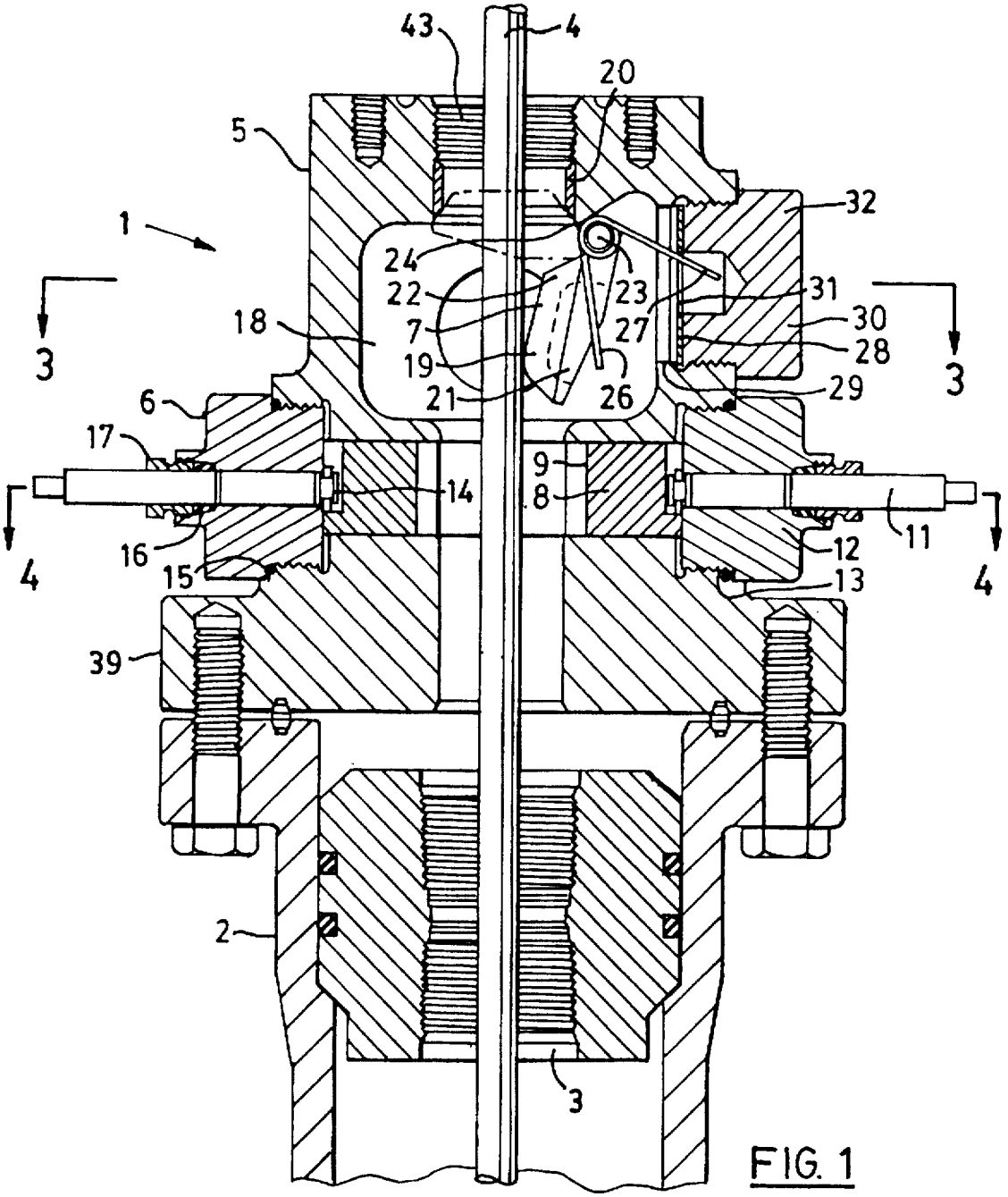
FIG. 1 is a side elevational view in longitudinal section of the oil well blow-out preventer and sealing device in accordance with the present invention.

Referring to FIG. 1, the oil well blow-out preventer and sealing device according to the present invention is noted generally by the reference numeral 1. Blow-out preventer and sealing device 1 is constructed for use on an oil well having a well casing with a wellhead 2 and a production tubing string 3. A pump rod 4 passes through, and is received within, production tubing string 3.

Device 1 is comprised generally of a central housing number 5, a blow-out prevention means 6, a flow passageway 42, a pump rod passageway 43 and a pump rod passageway sealing means 7. As shown, flow passageway 42 is in communication with production tubing string 3 and provides a means for fluid to be removed from the well. A pump rod passageway 43 provides a means to receive and retain pump rod 4 in that portion of the wellhead situated above production tubing string 3.

Figure 4:
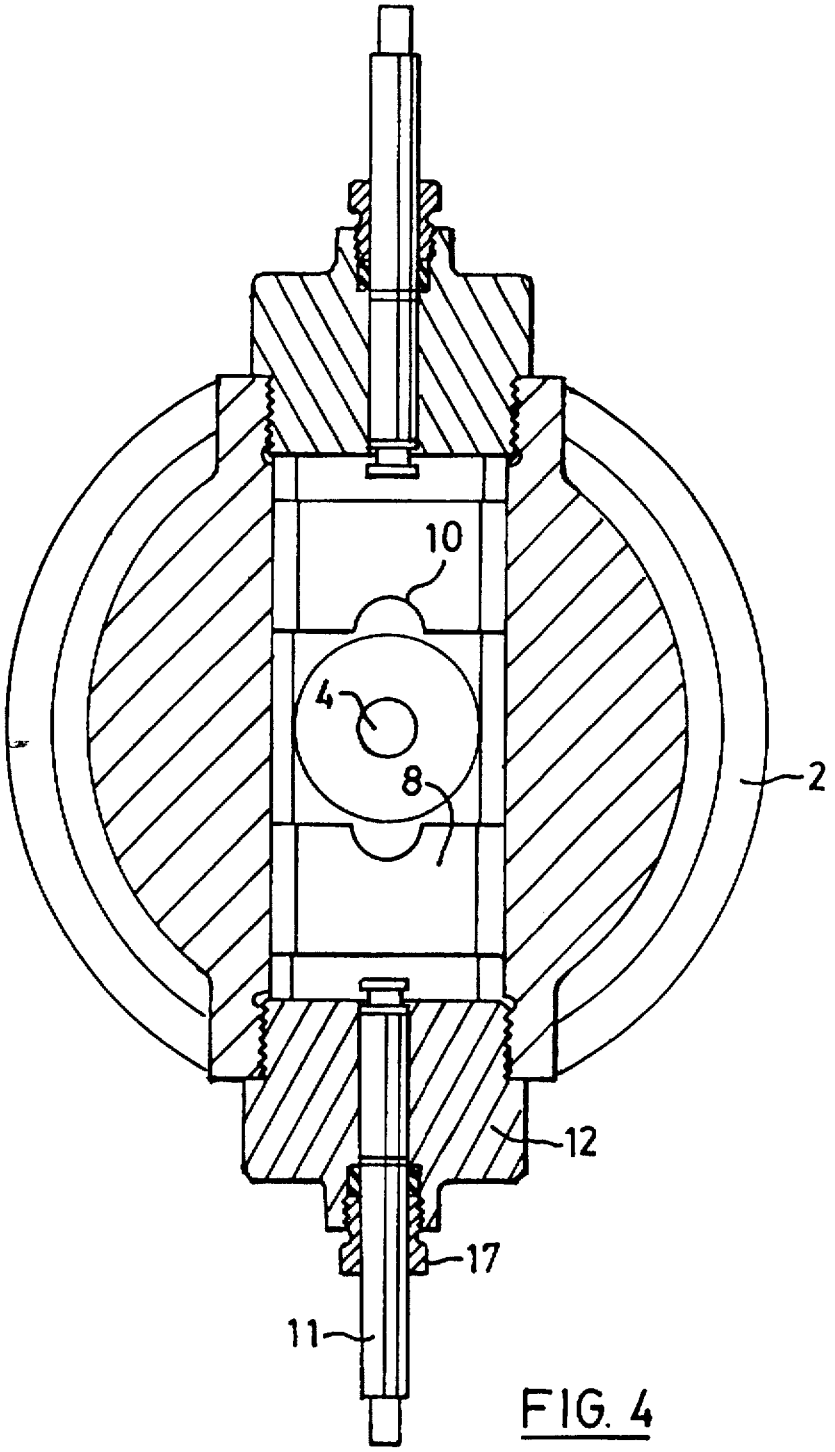

In the preferred embodiment, blow-out prevention means 6 comprises a pair of rams 8 that are adjustable to seal around pump rod 4 thereby effectively sealing off flow passageway 42 and pump rod passageway 43 to prevent the accidental loss or spillage of oil or fluid from the well. Typically, rams 8 would be comprised of a rubberized or neoprene block of material that is generally not affected by petroleum products. As is more clearly shown in FIG. 4, rams 8 contain a longitudinal semi-circular channel 10 on their internal surfaces 9. When adjusted inwardly channels 10 encompass pump rod 4 to form a tight seal around the rod.

Figure 3:
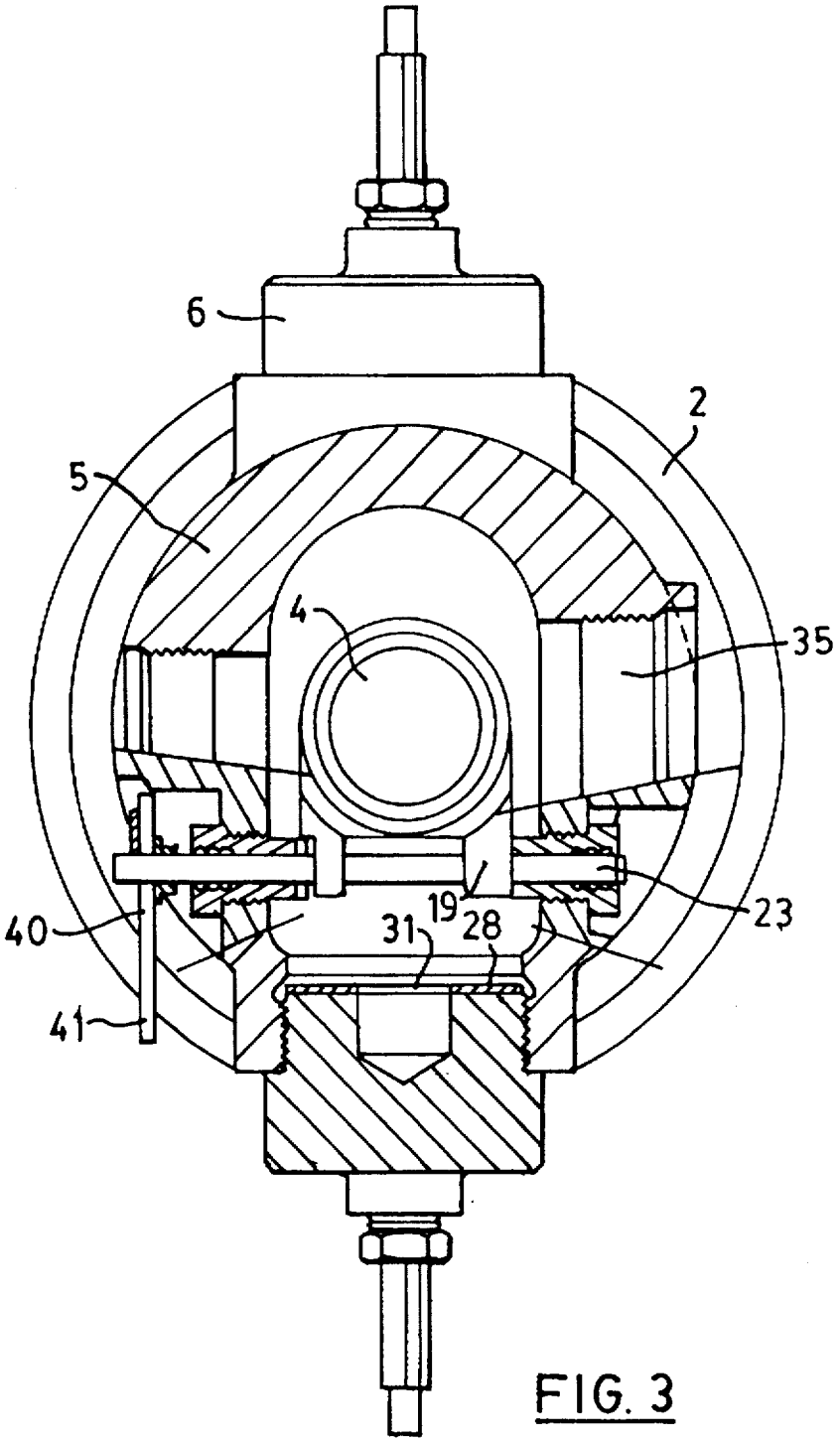
FIG. 3 is a sectional view of the device of FIG. 1 taken along the line 3—3; and, FIG. 4 is a sectional view of the device of FIG. 1 taken along the line 4—4.

Although a variety of different methods could be utilized to adjust or actuate rams 8, in the preferred embodiment, and as shown in FIGS. 1 and 3, rams 8 are adjustable inwardly or outwardly within central housing member 5 through rotating stems 11. Stems 11 are threadably received within blow-out prevention plugs 12 which are threaded into bores 13 within central housing member 5. The inner most ends 14 of stems 11 are attached to rams 8, but are free to rotate relative to the rams. Rams 8 may therefore be moved inwardly or outwardly through threading stems 11 into or out of blow-out prevention plugs 12.

As stated, when fully adjusted inwardly, rams 8 effectively seal off flow passageway 42 and pump rod passageway 43. When adjusted outwardly, rams 8 are moved free and clear from the flow passageways, offering no resistance to the flow from the well. To prevent leakage of fluids to the environment a seal 15 is placed between blow-out prevention plug 12 and central housing member 5. Typically seal 15 would comprise an O-ring. In addition, a stem seal 16 and a stem plug 17 prevent any leakage of fluid from between ram stems 11 and blow-out prevention plug 12.

Referring again to FIG. 1, pump rod passageway sealing means 7 is contained within an internal chamber 18 of central housing member 5. Sealing means 7 includes a rotatable valve member 19 that, in its closed position (shown in ghost outline in FIG. 1), engages a seating member 20 in pump rod passageway 43. Valve member 19 is comprised of a central body 21 having a circumferential seating base 22 for engaging seating member 20. Central body 21 preferably pivots about an axle 23 which is mounted in central housing member 5, generally perpendicular to passageway 43. It will thus be appreciated and understood that through mounting axle 23 generally perpendicular to pump rod passageway 43, pivotal movement of rotatable valve member 19 about axle 23 will allow circumferential seating base 22 to engage seating member 20 and thereby effectively seal off pump rod passageway 43.

Pump rod passageway sealing means 7 also includes biasing means 24 that urges rotatable valve member 19 into a position where circumferential seating base 22 bears against seating member 20. In the preferred embodiment, and as shown in FIG. 1, biasing means 24 comprises a spring 25. Spring 25 is positioned around axle 23 and has a pair of radially extending spring arms 26 and 27. Spring arm 26 is received within central body 21 of rotatable valve member 19, whereas spring arm 27 is held in a tensioned configuration, thereby imparting a biasing force upon rotatable valve member 19 and urging it toward seating member 20.

The amount of force necessary to rotate valve member 19, such that it fully engages seating member 20 and forms an effective seal therewith, will vary with the size of pump rod passageway 43. For this reason spring arm 27 is preferably biased against a removable plate 28 that is received within a bore 29 extending through the side of central housing member S. Bore 29 is preferably threaded so that a plug 30 may be screwed into it to retain removable plate 28 in place. It will therefore be appreciated that through the positioning of removable plate 28 along the length of bore 29 the degree of deflection of spring arm 27, and the resulting tensioning of spring 25, can be adjusted. Spring arm 27 can thus be deflected to the necessary degree to ensue that spring 25 is sufficiently tensioned to pivot rotatable valve member 19 so that it may engage seating member 20. In the preferred embodiment, removable plate 28 is equipped with a centralized hole 31 into which the end of spring arm 27 is received. Through the use of plates 28 having different sized holes 31, the amount of deflection of spring arm 27 can be varied as can the biasing force which spring 25 imparts upon rotatable valve member 19. In its simplest configuration, removable plate 28 may be a washer. Removable plate 28 also serves to hold spring arm 27 in place during assembly of device 1.

Bore 29 and plug 30 also serve the additional function of providing an access means 32 that may be utilized during assembly or for service. If it becomes necessary to access rotatable valve member 19, spring 25, or seating member 20, for purposes of maintenance or replacement, an operator need only remove plug 30 and removable plate 28 to have complete and open access to the components of pump rod passageway sealing means 7. For example, to perform maintenance on, or replace, rotatable valve member 19 or spring 25, an operator need only adjust rams 8 inwardly such that they seal around pump rod 4, remove plug 30 and perform the necessary maintenance or part replacement. Accessing pump rod passageway sealing means 7 in this manner can be accomplished without the need to remove any additional components of the oil well. Once the maintenance has been completed, plug 30 can be reinserted and rams 8 withdrawn to restore full production with little down time and related costs.

Referring again to FIG. 1, rotatable valve member 19 is shown to be in its normal position when pump rod 4 is received through pump rod passageway 43 and production tubing string 3. Under normal operating conditions, rotatable valve member 19 bears against pump rod 4 such that pump rod 4 holds rotatable valve member 19 in an open position. FIG. 1 also shows that internal chamber 18 is in direct communication with flow passageway 42 such that internal chamber 18 is filled with production oil when the oil well is in operation. Rotatable valve member 19 is therefore surrounded by a bath of oil which will self lubricate its point of contact with pump rod 4. This self lubrication assists in reducing frictional contact between rotatable valve member 19 and pump rod 4 to prevent wear and drag.

In the preferred embodiment of the present invention rotatable valve member 19 is comprised of stainless steel. Forming value member 19 from stainless steel will both allow for the production of a well machined and dimensioned seating base 22 and will provide a hard exterior surface that will be resistant to wear from coming into contact with pump rod 4.

In an alternate embodiment, circumferential seating base 22 of rotatable valve member 19 may be comprised of a rubberized or neoprene material. The rubberized or neoprene material will assist in helping to creating an effective seal between base 22 and seating member 20, and will also ensure that any wear that occurs between rotatable valve member 19 and pump rod 4 will occur on valve member 19.

In operation, should pump rod 4 break or be removed from production tubing string 3, the pump rod will no longer obstruct the movement of rotatable valve member 19. That is, upon the removal or breakage of pump rod 4, spring 25 will cause rotatable valve member 19 to engage seating member 20 and provide a means to automatically seal off pump rod passageway 43 to prevent the spillage of oil or fluid. When rotatable valve member 19 seals off passageway 43 in this fashion, circumferential seating base 22 is partially received within seating member 20 such that it "seats" against the smooth outer lip 33 of seating member 20.

As shown in FIG. 1 seating member 20 is threadably received within central housing member 5 thereby making it easier to produce a high quality, smooth seating surface than would be the case if seating member 20 were an integral part of central housing member 5. In this way seating member 20 can be removed and replaced if it becomes damaged or worn. In the preferred embodiment seating member 20 also includes a further sealing means 34. Typically sealing means 34 would comprise an O-ring that provides an additional seal between circumferential seating base 22 and seating member 20. It will be appreciated that where circumferential seating base 22 is comprised of stainless steel, O-ring 34 will help to prevent the leakage of fluid upon removal or breakage of the pump rod. Depending upon the tolerances between seating base 22 and seating member 20, O-ring 34 may in some cases act as the primary seal against leakage. Where circumferential seating base 22 is comprised of a rubberized or neoprene material, due to the flexibility of the rubberized or neoprene material O-ring 34 may not be necessary or may act as a back-up seal rather than a primary seal.

Figure 2:
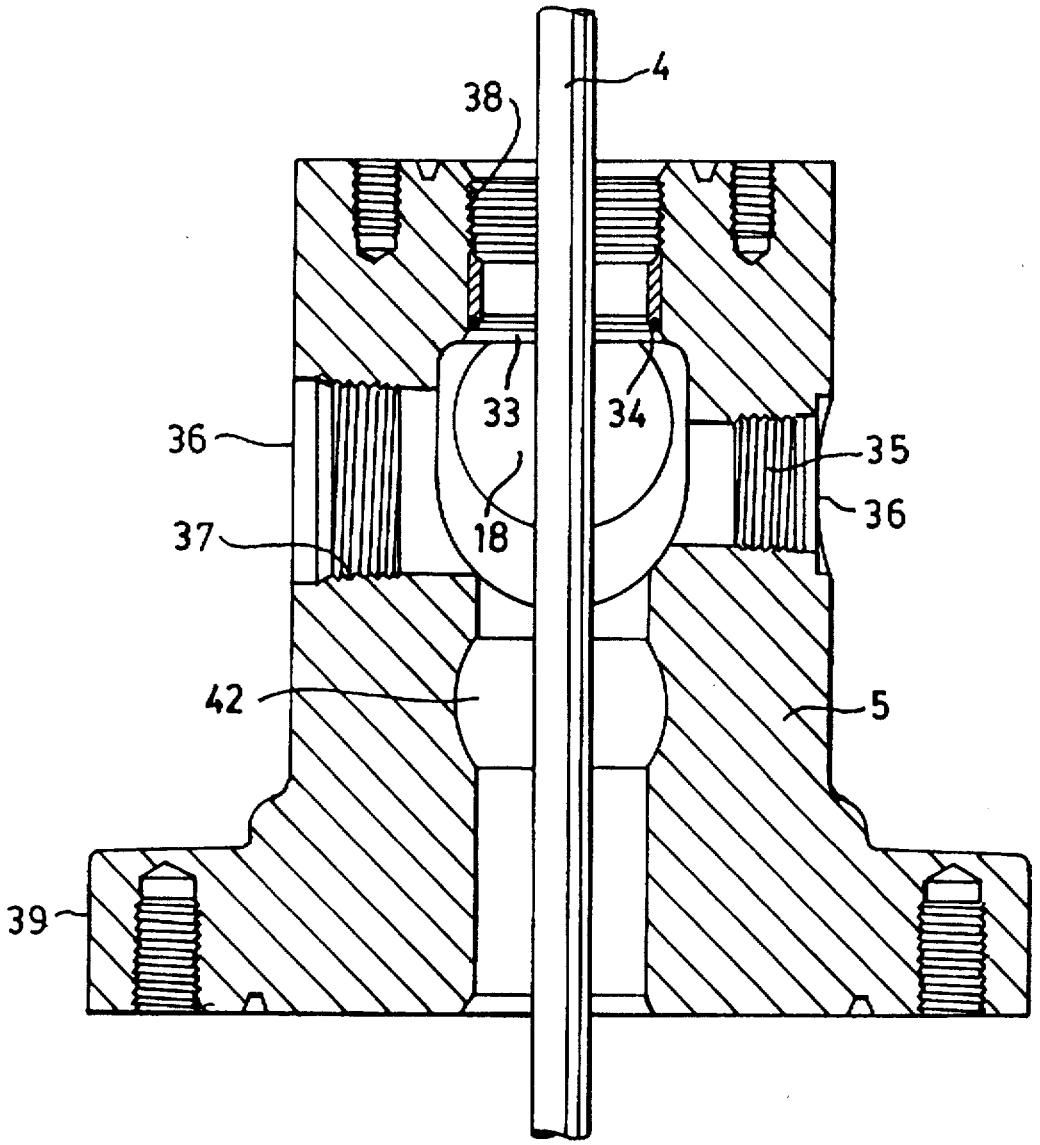
FIG. 2 is a side elevational view in longitudinal section of the blow-out preventer and sealing device of the present invention oriented 90 degrees to the section shown in FIG. 1.

In FIGS. 2 and 3 it will be noted that central housing member 5 includes an internal flow tee 35 that is connected to flow passageway 42 to provide a further means to transport fluid out of the oil well. The opposing ends 36 of flow tee 35 typically contain internal threads 37 such that distribution pipes may be screwed into ends 36 to deliver oil and fluids from the well to central collection tanks or distribution means.

Through the incorporation of blow-out prevention means 6, pump rod passageway sealing means 7, and flow tee 35 into central housing member 5, the applicant has created a compact mechanism that allows for the prevention of oil well blow-outs, automatic sealing to prevent the spillage of oil upon the breakage or removal of a pump rod, and integral means to deliver oil and fluid from the well to a centralized holding or distribution system. The compact nature of device 1 results in a reduction in the height of the wellhead, making access to the well and its above ground components simpler. Furthermore, a reduction in size over the prior art results in a significant weight reduction allowing for movement of device 1, its placement upon the wellhead, and servicing, to be accomplished more easily and with smaller and less costly lifting equipment.

To further facilitate in the movement of device 1, a set of internal lifting threads 38 are provided such that a lifting tool or rod can be screwed into threads 38. Finally, it will also be appreciated that through the incorporation of these various primary components within a central housing member 5, fewer connections and joints are presented thereby reducing the potential for leakage. The lighter and more compact central housing member also reduces the amount of torque to which an inclined or slanted wellhead is subjected, thereby helping to reduce casing failures and stress cracking.

The versatility of device 1 is enhanced through configuring its lower end 39 to be adaptable to a wide variety of oil well configurations. Depending upon the particular application lower end 39 may be bolted directly to the wellhead, may be connected to a tubing string hanging apparatus or it may be connected to a tubing rotator. Where device 1 is to be used in conjunction with a tubing rotator its lower end 39 may be formed integrally with the housing of the rotator to create a single combination apparatus.

Since producing oil wells are rarely under constant supervision, it is often the case that when a pump rod breaks it goes undetected for a length of time. A broken rod may also be difficult to detect from a distance. For this reason, device 1 also includes an external indication means 40 that identifies the relative position of rotatable valve member 19. In the preferred embodiment, external indication means 40 comprises a pointer or flag 41 fixed to axle 23. In the event that pump rod 4 breaks thereby causing rotatable valve member 19 to engage against seating member 20, pointer or flag 41 will provide a simple and easily recognizable indication means that will advise a technician that the rod has broken and that pump rod passageway sealing means 7 has been automatically activated to prevent the spillage of oil or fluid.

It is to be understood that what has been described are the preferred embodiments of the invention and that it is possible to make variations to these embodiments while staying within the broad scope of the invention. Some of these variations have been discussed while others will be readily apparent to those skilled in the art. For example, while valve member 19 has been described as a rotatable value member, it will be appreciated by those skilled in the art that it could also be comprised of a spring actuated slide or gate value member.

I claim:

1. An oil well blow-out preventer and sealing device for use on an oil well having a well casing, a wellhead, a production tubing string, and a pump rod receivable within the production tubing string, the device comprising:

(i) a central housing member for mounting on the wellhead, said central housing member including a flow passageway and a pump rod passageway, said flow passageway being in communication with the production tubing string and providing a means for fluid to be removed from the well, said pump rod passageway providing a means for entry of the pump rod into the well;

(ii) blow-out prevention means contained within said central housing member, said blow-out prevention means including a pair of rams that are adjustable to seal around the pump rod to prevent the accidental loss or spillage of oil or fluid from the oil well; and, (iii) pump rod passageway sealing means contained within said central housing member, said pump rod passageway sealing means preventing the spillage of fluids from the oil well upon the breakage or removal of the pump rod from said pump rod passageway, said pump rod passageway sealing means including a valve member that automatically seals said pump rod passageway, upon the breakage or removal of the pump rod from the well, through the engagement of said valve member with a seating member positioned in said central housing member circumferentially about said pump rod passageway.

2. A device as claimed in claim 1 wherein said pump rod passageway sealing means is contained within an internal chamber in said central housing member, said internal chamber being in direct communication with said flow passageway such that said internal chamber is filled with production oil when the oil well is in operation thereby providing a means to self-lubricate said pump rod passageway sealing means.

3. A device as claimed in claim 2 wherein said central housing member further includes means to access said pump rod passageway sealing means without the removal of said central housing member or said pump rod from the well casing.

4. A device as claimed in claim 3 wherein said valve member comprises a rotatable valve that automatically engages said seating member upon breakage or removal of the pump rod.

5. A device as claimed in claim 4 wherein said pump rod passageway sealing means includes biasing means to urge said rotatable valve member toward said seating member.

6. A device as claimed in claim 5 wherein said rotatable valve member bears against the pump rod such that the pump rod holds said rotatable valve member in an open position when the pump rod is inserted through said pump rod passageway.

7. A device as claimed in claim 6 wherein said means to access said pump rod passageway sealing means comprises a removable plug member that is threadably received within a bore in said central housing member, said bore communicating with said internal chamber.

8. A device as claimed in claim 7 wherein said biasing means comprises a spring.

9. A device as claimed in claim 8 wherein said central housing member includes an internal flow tee that is connected to, and in communication with, said flow passageway to provide a means to transport fluid out of the oil well.

10. A device as claimed in claim 9 wherein said spring is biased against a removable plate that is received within said bore.

11. A device as claimed in claim 10 wherein said removable plate is held in place by said removable plug member such that said spring urges said rotatable valve member toward said seating member.

12. A device as claimed in claim 11 wherein said rotatable valve member comprises a central body having a circumferential seating base for engaging said seating member, said rotatable valve member being pivotal about an axle that is mounted in said central housing member generally perpendicular to said pump rod passageway.

13. A device as claimed in claim 12 including external indication means to identify the relative position of said rotatable valve member.

14. A device as claimed in claim 13 wherein said seating member is threadably received within said central housing such that said seating member can be readily removed and replaced if damaged or worn.

15. A device as claimed in claim 14 wherein said seating member includes sealing means, said rotatable valve member engaging both said seating member and said sealing means upon the breakage or removal of the pump rod from the well.

16. A device as claimed in claim 15 wherein said sealing means comprises an O-ring.

17. A device as claimed in claim 16 including internal lifting threads, said lifting threads capable of threadably receiving a lifting rod to assist in the removal of said device from the wellhead.

18. A device as claimed in claim 17 wherein said external indication means comprises a pointer or flag fixed to said axle in said central housing.

19. A device as claimed in claim 18 wherein said removable plate is a washer.

20. A device as claimed in claim 3 wherein said valve member comprises a spring actuated slide gate to automatically engage said seating member upon breakage or removal of the pump rod.

* * * * *